US008836578B2

(12) United States Patent
Kenington

(10) Patent No.: US 8,836,578 B2
(45) Date of Patent: Sep. 16, 2014

(54) ANTENNA ARRAY

(71) Applicant: Ubidyne, Inc., Wilmington, DE (US)

(72) Inventor: Peter Kenington, Chepstow (GB)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 13/903,067

(22) Filed: May 28, 2013

(65) Prior Publication Data

US 2013/0265195 A1 Oct. 10, 2013

Related U.S. Application Data

(63) Continuation of application No. 12/566,735, filed on Sep. 25, 2009, now abandoned.

(60) Provisional application No. 61/100,430, filed on Sep. 26, 2008.

(30) Foreign Application Priority Data

Sep. 26, 2008 (GB) ..... 0817616.6

(51) Int. Cl.

| | |
|---|---|
| ***H01Q 3/00*** | (2006.01) |
| ***H01Q 3/26*** | (2006.01) |
| ***H01Q 1/24*** | (2006.01) |
| ***H01Q 21/06*** | (2006.01) |

(52) U.S. Cl.

CPC ..... *H01Q 1/246* (2013.01); *H01Q 3/26* (2013.01); *H01Q 21/061* (2013.01)

USPC ..... 342/372

(58) Field of Classification Search

CPC ..... H01Q 3/26; H01Q 21/061; H01Q 1/246

USPC ..... 372/372

See application file for complete search history.

(56) References Cited

U.S. PATENT DOCUMENTS

| | | | |
|---|---|---|---|
| 4,823,136 | A | 4/1989 | Nathanson et al. |
| 4,825,172 | A | 4/1989 | Thompson |

(Continued)

FOREIGN PATENT DOCUMENTS

| | | |
|---|---|---|
| EP | 508877 | 10/1992 |
| GB | 2238176 | 5/1991 |

(Continued)

OTHER PUBLICATIONS

U.K. Search Report issued in GB Appl. No. 0817616.6 on Nov. 21, 2008.

*Primary Examiner* — Frank J McGue

(74) *Attorney, Agent, or Firm* — Stephen H. Eland; Dann, Dorfman, Herrell & Skillman

(57) ABSTRACT

The present application relates to an antenna array that comprises a plurality of antenna elements and a plurality of amplifiers feeding the plurality of antenna elements. A first group of the plurality of antenna elements is arranged in a first column and a second group of the antenna elements is arranged in a second column. A first amplifier of the plurality of amplifiers has a first power rating and a second amplifier of the plurality of amplifiers has a second power rating, the first power rating being different than the second power rating. The first column is arranged symmetrical to the second column about an axis. Amplifiers feeding the first column have a substantially similar power rating to corresponding amplifiers feeding the second column.

14 Claims, 4 Drawing Sheets

(56) References Cited

U.S. PATENT DOCUMENTS

| | | | | |
|---|---|---|---|---|
| 4,868,902 | A * | 9/1989 | Sato | 250/332 |
| 5,327,147 | A | 7/1994 | Caille et al. | |
| 5,504,493 | A * | 4/1996 | Hirshfield | 342/372 |
| 5,548,292 | A | 8/1996 | Hirshfield et al. | |
| 6,472,934 | B1 | 10/2002 | Pehlke | |
| 6,504,516 | B1 | 1/2003 | Davis | |
| 6,512,474 | B2 | 1/2003 | Pergande | |
| 6,697,436 | B1 | 2/2004 | Wright et al. | |
| 6,844,863 | B2 | 1/2005 | Judd et al. | |
| 7,081,851 | B1 | 7/2006 | Lewis | |
| 2004/0066333 | A1 | 4/2004 | Judd et al. | |
| 2004/0085239 | A1 * | 5/2004 | Ukena et al. | 342/81 |
| 2005/0181751 | A1 * | 8/2005 | Fenk | 455/127.1 |
| 2005/0227642 | A1 | 10/2005 | Jensen | |

FOREIGN PATENT DOCUMENTS

| | | | |
|---|---|---|---|
| GB | 2238176 | A * | 5/1991 |
| WO | 96/17404 | | 6/1996 |
| WO | 02/095957 | | 11/2002 |

* cited by examiner

ANTENNA ARRAY

CROSS-REFERENCE TO RELATED APPLICATIONS

This application is a continuation of U.S. patent application Ser. No. 12/566,735, filed Sep. 25, 2009 which claims the priority of U.S. Provisional Application No. 61/100,430 and UK Patent Application GB 0817616.6, both filed on Sep. 26, 2008. The entire disclosure of each of the foregoing applications is incorporated herein by reference.

FIELD OF THE INVENTION

The field of the present application generally relates to an antenna array and in particular to a phased array used in wireless radio frequency communication. The field of the application also relates to a computer program product useable for the manufacture of the antenna array, and to a base transceiver station.

BACKGROUND OF THE INVENTION

Antennas that are used in mobile communications networks, such as GSM, CDMA, TDMA, or UMTS are often designed as antenna arrays. An antenna array comprises a plurality of antenna elements that are distributed in a one-dimensional or two-dimensional manner. Each of the antenna elements transmits or receives basically the same signal. However, by introducing a different phase shift for each of the antenna elements, the radiation distribution of the antenna array, in particular its shape and its direction, can be modified up to a certain degree.

In a normal operating scenario, an antenna array is likely to have an unequal and predictable power distribution across its antenna elements. More power will typically be required for the central antenna elements and less for outer ones.

U.S. Pat. No. 5,504,493, entitled "Active Transmit Phased Array Antenna with Amplitude Taper", issued to Hirshfield and assigned to Globalstar L. P. on Apr. 2, 1996 describes a phase array transmitting antenna system, including a plurality of radiating elements. One or more constant phase and amplitude amplifiers are affixed to the radiating element in the array, wherein the radiating element is capable of producing radiation having a certain phase and amplitude that is distinct from the phase and amplitude of radiation produced by most of the other radiating elements. The amplifiers need to track one another in both amplitude and phase transfer characteristics. U.S. Pat. No. 5,504,493 therefore suggests using substantially identical amplifiers. This means that especially the outer amplifiers have to be operated in a range of operation that is beneath that of the optimal range of operation for the amplifiers. Therefore, especially the outer amplifiers tend to show rather poor efficiency. In addition, amplifiers having higher power ratings are usually more expensive than those having lower power ratings. The entire disclosure of U.S. Pat. No. 5,504,493 is hereby incorporated into the description by reference.

U.S. Pat. No. 4,825,172, entitled "Equal Power Amplifier System for Active Phase Array Antenna and Method of Arranging Same", issued to Thompson and assigned to Hughes Aircraft Company discloses the use of a plurality of equal-power RF power amplifiers attached to a plurality of antenna elements. Each RF power amplifier is utilised at a power level close to, or at, peak efficiency in such a way as to provide a range of transmitted power levels from the antenna elements. Each RF power amplifier is composed from a combined pair of identical amplifiers. Constructive/destructive interference is used in the combiner to provide the desired signal power level. The teachings disclosed in U.S. Pat. No. 4,825,172 find application in satellite communication which requires relatively high power levels. The antenna array disclosed in U.S. Pat. No. 4,825,172 is a linear, one-dimensional array. The entire disclosure of U.S. Pat. No. 4,825,172 is hereby incorporated into the description by reference.

SUMMARY OF THE INVENTION

In a first aspect relative to an antenna array, it would be desirable to improve the power efficiency of the antenna array and to reduce the cost of the antenna array. At least one of these concerns is addressed by an antenna element that comprises a plurality of antenna elements and a plurality of amplifiers having power ratings and feeding the plurality of antenna elements. A first group of the antenna elements is arranged in a first column of the antenna array and a second group of antenna elements is arranged in a second column of the antenna array. A first amplifier of the plurality of amplifiers has a first power rating and a second amplifier of the plurality of amplifiers has a second power rating. The first power rating is different from the second power rating. The first column of the plurality of antenna elements is arranged symmetrical to the second column of the plurality of antenna elements about an axis, and amplifiers feeding the first column of the plurality of antenna elements have a substantially similar power rating to corresponding amplifiers feeding the second column of antenna elements.

There is not necessarily a 1-to-1 relation between one of the antenna elements and one of the amplifiers. Instead, a single amplifier may feed several antenna elements, or several amplifiers may feed a single antenna element. An antenna element may comprise several sub-components, such as two dipoles forming an X and being fed by signals with a 90° shift between them which leads to circularly polarised radiation. The different amplifiers are operated closer to their specifications which will effectively improve the available power from the antenna array and its efficiency. Besides the first column and the second column the antenna array may comprise further columns.

It would be further desirable if the power ratings are organized in a certain manner that facilitates and assists in obtaining a desired radiation distribution. In an aspect of what is taught this concern is addressed by the power ratings of the amplifiers being chosen to form a power distribution profile over the antenna array. Besides a specific phase shift between the signals transmitted by the antenna elements, driving the antenna elements with different amplitudes provides more flexibility for forming the radiation distribution.

It would also be desirable to arrange the amplifiers having different power ratings in a manner that is usable for many desired radiation distributions. In an aspect of what is taught this concern is addressed by the antenna array comprising an edge and the power rating of the amplifiers tapering towards the edge of the antenna element array. Many of the practical radiation distributions require higher power in the centre and less towards the edges. Tapering the power ratings towards the edges predicts and fits many power distribution profiles that may be encountered in commonly-used situations such as infrastructure antenna arrays used in mobile communications systems.

It would also be desirable to keep the number of different types of amplifiers in a reasonable range. In an aspect of what is taught this concern is addressed by the plurality of amplifiers being subdivided into two or more subsets of amplifiers, the power ratings of the amplifiers within one of the two or more subsets being substantially equal. A crude stepping of power ratings may be a good compromise between maintaining a manageable range of radio modules for production, maximising useable output power and also maximising overall power efficiency for the system.

It would be desirable to achieve economies of scale in the production of the amplifiers. In an aspect of what is taught this is achieved by the first amplifier comprising two or more identical elementary amplifying devices having a first elementary power rating, and the second amplifier comprising at least one elementary amplifying device having a second elementary power rating. For example, assume that the first amplifier is a 2 W amplifier and the second amplifier is a 3 W amplifier. Available elementary amplifying devices have power ratings of 1 W and 3 W. The first amplifier could be formed by using two 1 W elementary amplifying devices. The second amplifier could be formed by one 3 W elementary amplifying device.

It would be desirable that the amplifiers react in a substantially similar manner to environmental changes, such as variations of a temperature or of a supply voltage. In an aspect of what is taught this concern is addressed by the first amplifier and the second amplifier using identical device technology.

It would be desirable for some applications that the antenna array has a high operating frequency and/or high available output power. For other applications it would be desirable to keep costs low. In an aspect of what is taught these concerns are addressed by the identical device technology being selected from the group consisting of lateral double-diffused MOSFET (LDMOS) technology, GaAs MESFET technology, and high electron mobility transistor (HEMT) technology. Lateral double-diffused MOSFET technology provides good linearity and efficiency for output powers up to 100 W at frequencies as high as 3.5 GHz and possibly even higher frequencies in the future. LDMOS devices present a high breakdown voltage. The GaAs MESFET (Gallium Arsenide Metal semiconductor field effect transistor) technology is relatively cheap to produce, has a breakdown voltage of up to 20 volt and resists channel temperatures up to 150° C. High electron mobility technology is available as GaAS PHEMT (pseudomorphic high electron mobility technology), GaAs MHEMT (metamorphic high electron mobility technology), GaN (Gallium Nitride) HEMT, among others.

It would be desirable to use a building block approach for the antenna array in order to facilitate the production process, for example. In an aspect of what is taught this concern is addressed by the antenna array further comprising a plurality of high power transceivers, each one of the high power transceivers comprising an antenna element of said plurality of antenna elements and an amplifier of said plurality of amplifiers.

It would be desirable that the antenna array produces a desired radiation distribution with no or only a small error. In an aspect of what is taught this concern is addressed by the antenna array further comprising a compensator arranged to determine and compensate for at least one of amplitude, phase, delay and/or linearity deviations of at least one of the plurality of high power transceivers. The amplitude, phase and/or linearity deviation(s) may be measured from a common amplitude, phase and/or linearity value. The compensator may attempt to adjust one or several parameters of the high power transceivers so that the deviation becomes minimal, assumes a desired value or exceeds a desired specification (in the case of linearity).

It would be desirable that each high power transceiver can be adjusted in an individual manner. In an aspect of what is taught this concern is addressed by the antenna array comprising a plurality of said compensators, each one of said plurality of compensators being associated to one of the plurality of high power transceivers. The compensators may exchange information among each other so that each of the high power transceivers can be adjusted in a manner that is coherent with the overall radiation distribution. The compensators may also be connected to a common comparator that performs e.g. data collection, processing, gathering and analysing.

It would be desirable that adjusting the individual high power transceivers is done in a coherent manner. In an aspect of what is taught this concern is addressed by the plurality of compensators being arranged to determine at least one of relative amplitude, phase and/or linearity deviations relative to an aggregate value for the amplitude, phase and/or linearity. The aggregate value is calculated on the basis of all or some of the measured values. The aggregate value may be e.g. an average value, cumulate value, maximal value or minimal value.

It would be desirable that parameters that have a strong influence on the radiation distribution of the antenna array are subject to adjustment. In an aspect of what is taught this concern is addressed by the compensator being arranged to adjust at least one of an amplitude setting, a phase setting, a delay setting or a linearity setting of a corresponding one of the plurality of high power transceivers so as to reduce the amplitude, phase and/or linearity deviation of the corresponding one of the plurality of high power transceivers.

In a further aspect it would be desirable that the remarks made above apply also to a base transceiver station in a mobile telecommunications network. In an aspect of what is taught this concern is addressed by the base transceiver station comprising the antenna array as described above.

It would be desirable to facilitate the design and/or production of the base transceiver station. It would also be desirable to use facilities that are already provided for in the base transceiver station in combination with an antenna array as described above. In an aspect of what is taught this concern is addressed by at least one of the plurality of high power transceivers being arranged to receive a baseband signal to be transmitted and comprising a modulator for modulating the baseband signal and an up-converter for performing a frequency translation of the base band signal. The base transceiver station may already comprise a digital linearization unit for the linearization of the high power transceivers and/or other equipment. The digital linearization unit usually has infrastructure that may be used for the compensator(s) of the high power transceivers, as well. This infrastructure may comprise one or several couplers, feedback paths, and a digital signal processor.

In a further aspect of what is taught herein, a computer program product is proposed. The computer-program product is embodied on a computer-readable medium and comprises executable instructions for the manufacture of the antenna array described above.

As a general remark with respect to the cited art, offering only a uniform power amplifier size for each antenna element will effectively reduce the available power from the antenna, if both amplitude and phase weightings are used in the forming and/or steering of the antenna beam. The use of both amplitude and phase based beamforming and steering (as opposed to phase-only beamforming/steering) is significantly more versatile, allowing a wide range of beam shapes and beamwidths to be formed from a given antenna array.

With respect to what is taught herein, a building block approach may be retained and there are at least two versions of building blocks with different power ratings. e.g. the different building blocks of "high power transceivers" have differently sized power amplifiers. Non-uniform power distribution will give a greater effective output power from the antenna array without increasing the amount of RF silicon or decreasing system power efficiency. The useable antenna ouput power/range is improved for most commonly-used situations. The teachings disclosed herein require no or only little added RF silicon resulting in substantially cost neutral production compared to the cited art. A higher ratio between usable output power and amount of RF silicon (GaN) can probably be achieved (i.e. the RF device power available to the system is utilised at, or close to, its full potential). It is expected that a greater transmit range can be achieved for a given DC input power and for a given product cost. In the case of a linear power amplifier based system it is expected to achieve greater overall power efficiency with the teachings disclosed herein, since more of the power amplifiers will be operating close to or at their maximum output power level.

These and other aspects of the disclosed antenna array, base transceiver station, apparatus, method or computer-program product will be apparent from and elucidated with reference to the embodiment(s) described herein after.

DETAILED DESCRIPTIONS OF THE EMBODIMENTS

For a complete understanding of what is taught and the advantages thereof, reference is now made to the following detailed description taken in conjunction with the Figures.

It should be appreciated that the various aspects of the disclosed antenna array, base transceiver station, apparatus, method or computer-program product discussed herein are merely illustrative of the specific ways to make and use the disclosed antenna array, base transceiver station, apparatus, method or computer-program product and do not therefore limit the scope of what is disclosed when taken into consideration with the claims and the following detailed description. It will also be appreciated that features from one embodiment of the disclosed antenna array, base transceiver station, apparatus, method or computer-program product may be combined with features from another embodiment of the disclosed antenna array, base transceiver station, apparatus, method or computer-program product.

Figure 1:
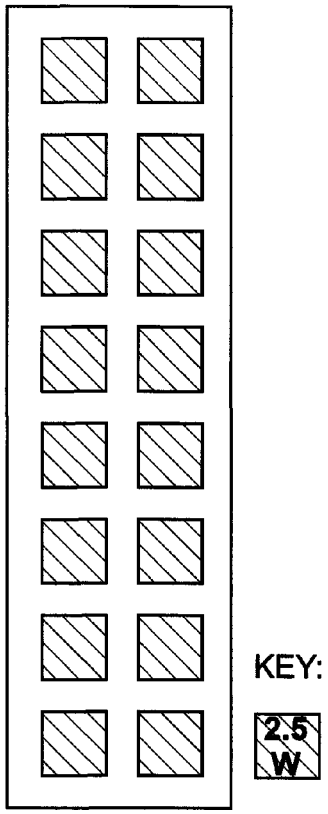
(prior art) FIG. 1
FIG. 1 shows a schematic front view of an antenna array according to the prior art.

FIG. 1 shows a schematic front view of an antenna array according to the prior art. The antenna array comprises 16 individual antenna elements that are depicted as small squares in FIG. 1. The antenna elements are arranged in two columns of eight antenna elements. Each antenna element is fed by an individual amplifier. All of the 16 amplifiers are identical in their power rating, which in the depicted case was chosen to be 2.5 W. The key illustrated between FIG. 1 and FIG. 2 indicates the mapping between hatching and power rating. The total power rating of the antenna array is 16×2.5 W=40 W.

Figure 2:
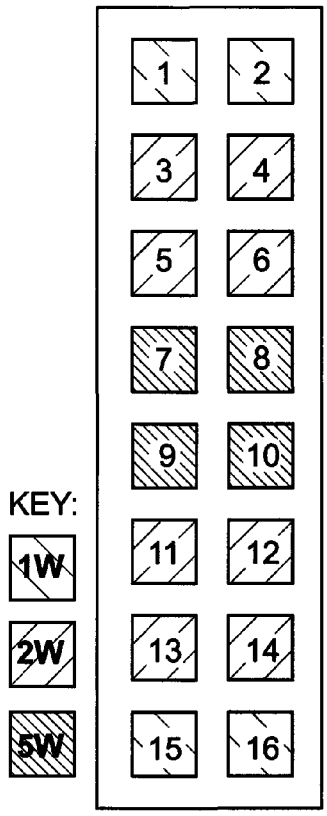
FIG. 2 shows a schematic front view of an antenna array according to the teachings disclosed herein.

FIG. 2 shows a schematic front view of an antenna array according to one of the teachings disclosed herein. Again, an antenna array with 8×2=16 pairs of antenna elements and amplifiers is shown. The 16 amplifiers can be grouped in three groups of different power ratings. Amplifiers number 1, 2, 15 and 16 belong to the first group and all have a power rating of 1 W each. Amplifiers 3 to 6 and 11 to 14 belong to the second group and have a power rating of 2 W each. Amplifiers 7 to 10 belong to the third group and have a power rating of 5 W each. The first group of amplifiers is positioned at the two edges of the antenna array, two amplifiers at each edge. The third group of four amplifiers is positioned in the centre of the antenna array. The second group of eight amplifiers is positioned at two locations between the centre and the upper and lower edge, respectively. The exemplary antenna array shown in FIG. 2 presents horizontal symmetry. The total power rating of the antenna array equals 4×1 W+8×2 W+4×5 W=40 W, i.e. the same as in the case of FIG. 1. The antenna elements having odd numbers belong to a first group of antenna elements arranged in a first column. The antenna elements having even numbers belong to a second group of antenna elements arranged in a second column. An axis of symmetry extends vertically between the first column and the second column. Thus, the power rating of the amplifier connected to antenna element 1 has the same power rating as the amplifier connected to antenna element 2, and so on. The arrangement of the amplifiers themselves need not be in columns and/or symmetrical.

Figure 3:
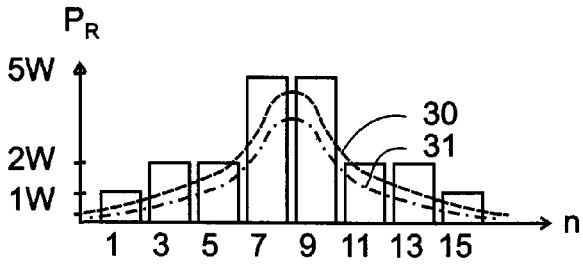
FIG. 3 shows a schematic diagram of the power rating distribution of the amplifiers of an antenna array according to the teachings disclosed herein.

FIG. 3 shows a schematic diagram of the power rating distribution of the amplifiers of an antenna array according to at least one of the teachings disclosed herein. The abscissa of the diagram indicates the number n of the antenna element. The ordinate shows the power rating of one antenna element. The power rating is 1 W for antenna elements number 1 and 2, respectively. The next four antenna elements each have a power rating of 2 W. The four centre antenna elements have a relatively high power rating of 5 W. To the right, the diagram continues in a symmetrical manner. A curve 30 shows a power profile that is required and/or predetermined for a specific mode of operation of the antenna array, e.g. for a large coverage area. Another curve 31 shows a different power profile that required/predetermined for a weaker mode of operation, e.g. for a smaller coverage area in an urban environment. The power rating distribution is greater than the power profile curve 30 so that a power profile according to curve 30 can be obtained by slightly attenuating either the supply voltage or the input signals of the respective amplifiers. However, this attenuation is weak and does not notably degrade the power efficiency of the antenna array.

Figure 4:
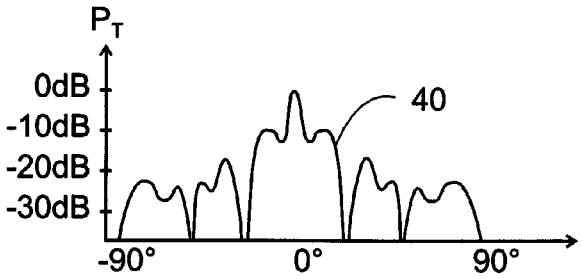
FIG. 4 shows a schematic diagram of the radiation distribution of an antenna array according to the teachings disclosed herein.

FIG. 4 shows a schematic diagram of the radiation distribution 40 of an antenna array according to the teachings disclosed herein. The diagram illustrates the dependency of the radiation power on the elevation angle. An elevation angle of 0° corresponds to a boresight direction of the antenna array (not necessarily the horizontal direction). The radiation distribution presents a main lobe ranging from about −20° to +20° and having a power substantially between −10 dB and 0 dB. A small gap separates the main lobe from the 1st side lobes. The 1st side lobes extend over approximately 20° each and have a power between −25 dB and −20 dB. Towards the outer edges of the radiation distribution the two 2nd side lobes can be observed that have a power approximately between −30 dB and −25 dB. The radiation distribution shown in FIG. 4 is purely exemplary. Depending on the chosen phase and amplitude values for the various antenna elements of the antenna array, the radiation distribution may be more uniform, show fewer or no gaps, or even shifted about some degrees in order to implement an electronic tilt angle.

Figure 5:
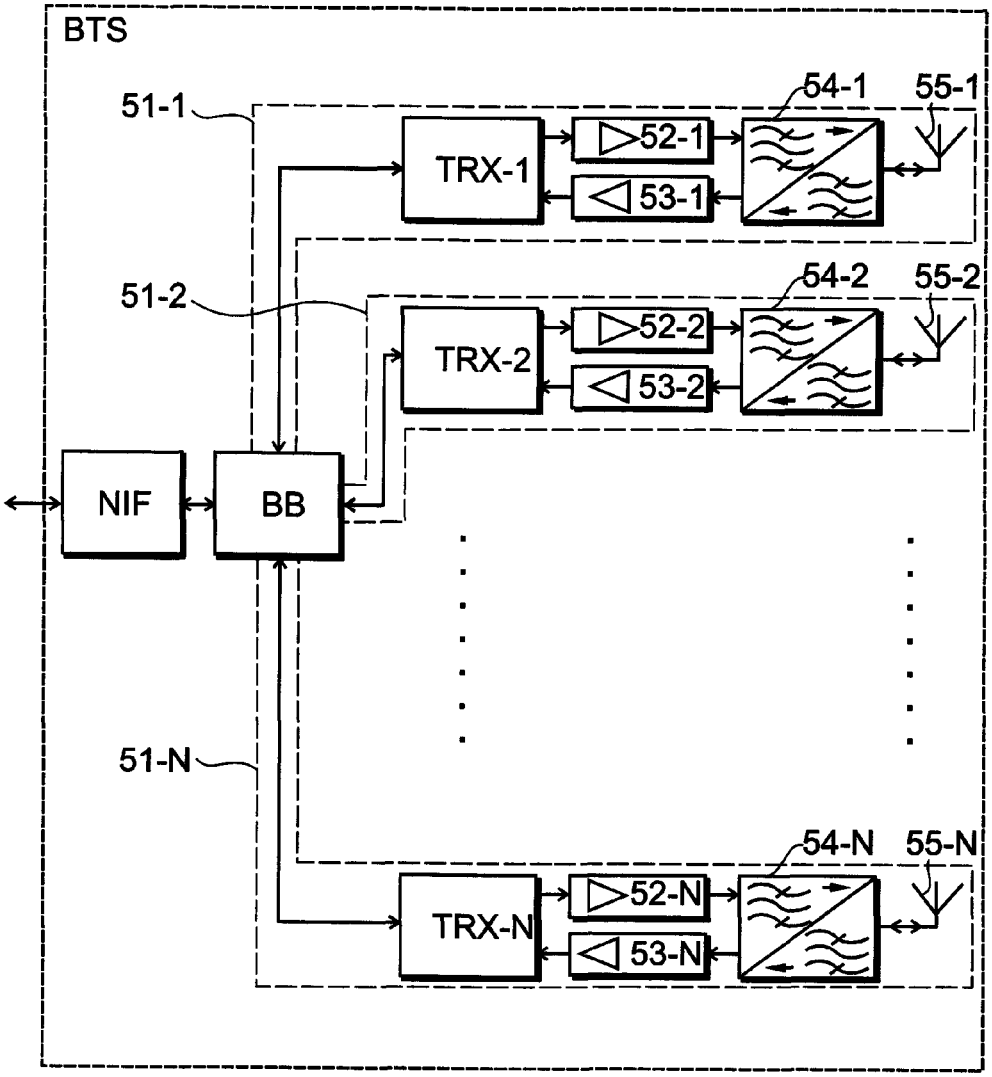
FIG. 5 shows a schematic block diagram of a base transceiver station comprising an antenna array according to the teachings disclosed herein.

FIG. 5 shows a schematic block diagram of a base transceiver station BTS. The base transceiver station BTS comprises a network interface NIF for connection to a base station controller BSC over e.g. an E1/T1 line. The network interface NIF may comprise a base station controller interface and a unit for circuit switch control and signalling. A base band signal processing unit BB is connected to the network interface. Typical tasks of the base band signal processing unit BB are, for example: symbol encoding/decoding, symbol modulation/demodulation, filtering and pre-distortion. In the transmit direction, the base band signal processing unit BB produces one or several base band signals for further processing, for example up-conversion, modulation, digital-to-analogue conversion and amplification. In the receive direction, the base band signal processing unit BB receives one or several signals at base band frequency from a plurality of high power transceivers 51-1, 51-2, . . . 51-N. Broadly speaking, a high power transceiver may be defined as a device that, in the transmit direction, takes an input signal at base frequency or an intermediate frequency, performs modulation (for base band input signals), frequency translation and power amplification. In the receive direction, the high power transceiver performs an amplification of the signal(s) received via the air interface, frequency translation and demodulation to produce a base band output signal or an intermediate frequency output signal.

In the architecture shown in FIG. 5, each high power transceiver 51-1, 51-2, . . . 51-N comprises a transceiver TRX-1, TRX-2, . . . TRX-N, an amplifier 52-1, 52-2, . . . 52-N, a duplex filter 54-1, 54-2, 54-N, and an antenna element 55-1, 55-2, . . . 55-N. Taking high power transceiver 51-1 as a representative example, the details of the high power amplifiers will now be described. High power transceiver 51-1 is connected to one of the ports of base band signal processing unit BB. In the transmit direction, high power transceiver 51-1 receives a signal to be transmitted from the base band signal processing unit BB. In the receive direction, high power transceiver 51-1 provides digital signals to the base band signal processing unit BB, wherein these signals may be filtered, down-converted and/or demodulated in a manner appropriate for further processing by the base band signal processing unit BB.

The transceiver TRX-1 substantially performs up-/down-conversion, digital-to-analogue conversion and analogue-to-digital conversion. Signal processing within the transceiver TRX-1 may be mostly analogue, digital, or a mixture of both. The tasks of up-conversion and down-conversion may make use of an intermediate frequency. In the architecture illustrated in FIG. 5 transceiver TRX-1 is connected to the base band signal processing unit via a bi-directional link. In the alternative, separate uni-directional links for the transmit direction and the receive direction may used, as well. A transmit amplifier 52-1 and a receive amplifier 53-1 are connected to the transceiver TRX-1 at a radio-frequency side of the transceiver. The transmit amplifier 52-1 provides an amplified signal to a duplex filter 54-1 which makes sure that the signal transmitted over the air maintains a required spectral mask. Duplex filter 54-1 also makes sure that the transmit path does not produce significant crosstalk in the receive path. Duplex filter 54-1 is also connected to an antenna element 55-1 serving as an air interface to a mobile station (not illustrated).

The other high power transceivers are substantially similar to the 51-2, . . . 51-N to the high power transceiver 51-1. However, the transmit amplifiers 52-1, 52-2, . . . 52-N may have different power ratings. The power ratings of the amplifiers may be chosen according to a certain profile, wherein the profile provides for e.g. a higher power rating of the amplifiers in the centre of the antenna array and lower power rating of the amplifiers towards the edges of the antenna array.

Figure 6:
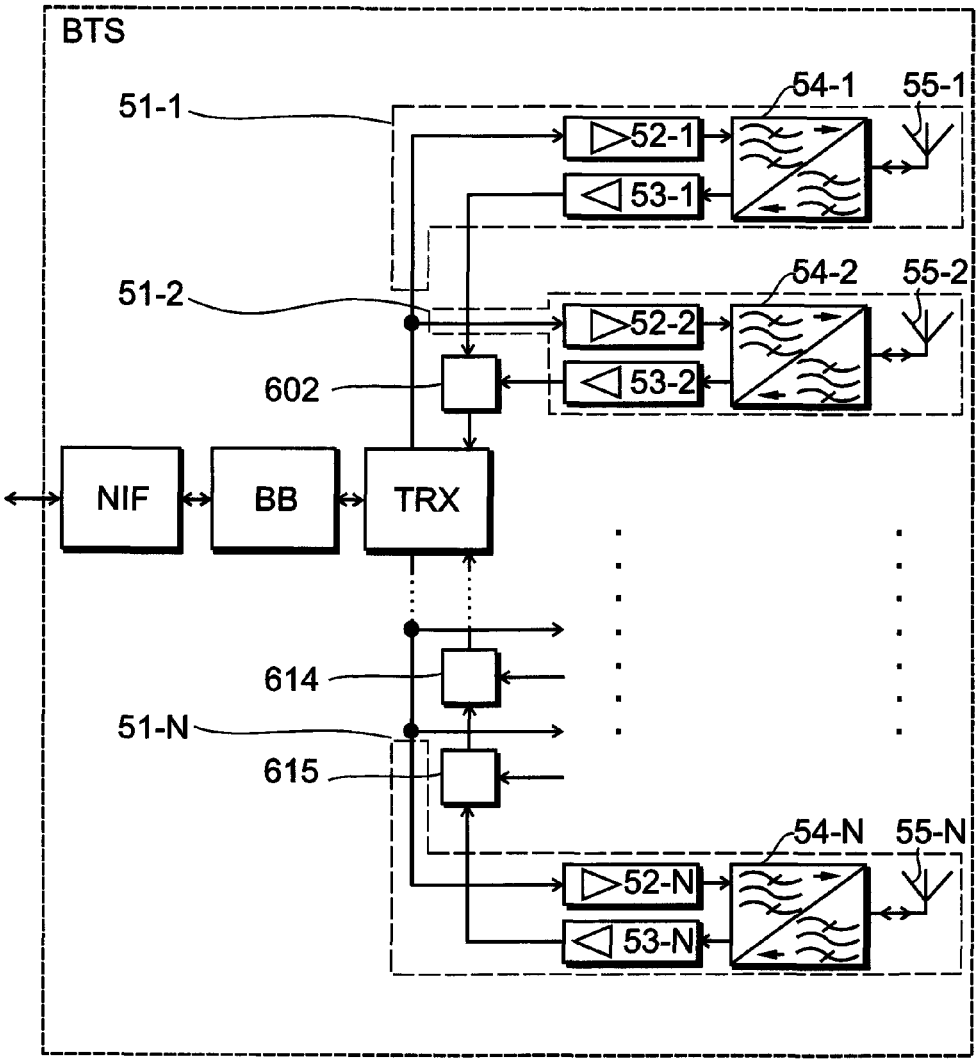
FIG. 6 shows a schematic block diagram of another base transceiver station comprising an antenna array according to the teachings disclosed herein.

FIG. 6 shows another possible architecture of a base transceiver station BTS. In comparison to FIG. 5, the following components are substantially identical: the network interface NIF, the base band signal processing unit BB, the transmit amplifiers 52-1, 52-2, . . . 52-N, the receive amplifiers 53-1, 53-2, . . . 53-N, the duplex filters 54-1, 54-2, . . . 54-N and the antenna elements 55-1, 55-2, . . . 55-N. The architecture shown in FIG. 6 differs from that of FIG. 5 in that only one transceiver is used to serve all of the high power transceivers 51-1, 51-2, 51-N.

In the transmit direction, the transceiver provides a radio frequency signal to a distribution network leading to the amplifiers 52-1, 52-2, . . . 52-N. The distribution network comprises several branch nodes at which the radio frequency signal is distributed to two or more branches of the distribution network. The branch nodes may introduce a specific phase shift and amplitude gain or attenuation for each of the branches. Thus, each of the amplifiers 52-1, 52-2, . . . 52-N receives a phase shifted and amplitude attenuated version of the radio frequency signal. Suitable design of the distribution network allows to provide each amplifier 52-1, 52-2, . . . 52-N with a version of the radio-frequency signal that has the required phase shift and amplitude attenuation for obtaining a desired radiation distribution of the antenna array. As with FIG. 5, the amplifiers 52-1, 52-2, . . . 52-N have different power ratings. In the alternative or the addition to using an individual amplitude gain or attenuation of a signal supplied to the various high power transceivers, a gain of each of the transmit amplifiers 52-1, 52-2, 52-N could be individually adjusted.

In the receive direction, a combination network is provided that receives signals from the receive amplifiers 53-1, 53-2, . . . 53-N, combines them in an appropriate manner, and delivers a combined signal to the transceiver TRX. To this end, the combination network comprises several signal combiners 602, 614 and 615 for combining two or more received signals while obeying their mutual phase relation.

Figure 7:
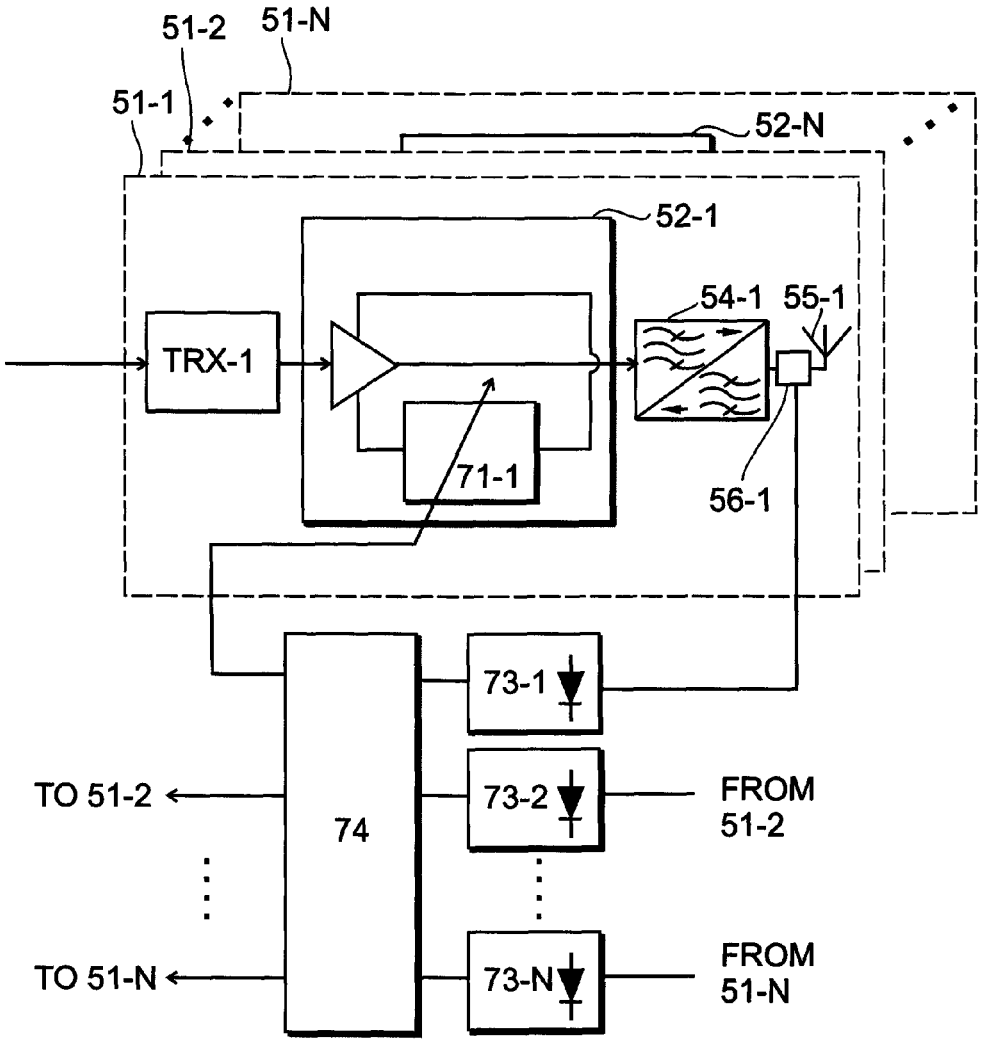
FIG. 7 shows a more detailed block diagram of a high power transceiver of an antenna array according to the teachings disclosed herein.

FIG. 7 shows a more detailed block diagram of a transmit part of the high power transceivers in a base transceiver station BTS as shown in FIG. 5. When using amplifiers having different power ratings in the various high power transceivers of an antenna array, the amplifiers must be tracked in phase and amplitude. The reason is that amplifiers typically present a significant spread in their operating parameters, such as gain and phase shift. One way to reduce this spread is to use amplifiers from the same batch of production. However, this solution is not readily available for amplifiers having different power ratings, because these are different by design. As an alternative, the amplifiers may be actively tracked. In some architectures of base transceiver stations such tracking already is provided for in order to optimally adjust a digital pre-distortion applied to the signal at base band frequency. This technique is also called transmitter linearization. The use of digital transmitter linearization in analogue transmitters or all-digital transmitters (and possibly with the use of calibration, as well) will ensure that all high power transceivers track each other very accurately in amplitude and phase, without the need to use combinations of identical amplifiers. Digital transmitter linearization may be based on clocks derived from a common reference. The accuracy of output power tracking is thus ensured virtually irrespective of the performance or type of amplifiers used.

FIG. 7 shows the high power transceivers 51-1, 51-2, . . . 51-N. Only high power transceiver 51-1 is shown more in detail and shall be representative for the other high power transceivers. Reference is made to FIG. 5 for a description of the transceiver TRX-1, the duplex filter 54-1 and the antenna element 55-1. A compensator for compensating deviations of the gain and the phase shift comprises a coupler 56-1, a power detector or peak detector 73-1, a common comparator 74 and a parameter adjuster 71-1. The coupler 56-1 picks up the signal sent from the duplex filter 54-1 to the antenna element 55-1 and sends it to the power detector 73-1. The power detector determines e.g. the average power or the maximal power that is transmitted via antenna element 55-1. A value or signal corresponding to the average power or the maximal power is send to the common comparator 74. Common comparator 74 compares the determined average powers or maximal powers of the high power transceivers 51-1, 51-2, . . . 51-N with each other and with the power profile. In addition, phase shifts between signal sent to the antenna elements 55-1, 55-2, . . . 55-N of the high power transceivers 51-1, 51-2, . . . 51-N may be determined. Deviations between the determined average power or maximal power and the desired power profile are also determined by comparator 74. Note that under most conditions it is sufficient to determine a relative deviation between the determined average power values of the high power transceivers 51-1, 51-2, . . . 51-N. The comparator 74 calculates control signals for the parameter adjuster 71-1. The parameter adjuster may be a supply voltage modulator or a gain factor adjuster for an amplifying element within amplifier 52-1. In dependence from the control signal, the supply voltage and/or the gain factor of the amplifying element are modified so as to compensate for the determined deviations. Note that the function of the compensator could be integrated with other adjusting functions, such as the digital linearization as mentioned above.

FIG. 7 shows the compensator for high power transceiver 51-1 in a manner that is representative of the compensators for the other high power transceivers 51-2, . . . 51-N.

While various embodiments of the disclosed antenna array, base transceiver station, apparatus, method or computer-program product have been described above, it should be understood that they have been presented by way of example, and not limitation. It will be apparent to persons skilled in the relevant arts that various changes in form and detail can be made therein without departing from the scope of what is taught. For example, any bipolar transistors depicted in the drawings and/or described in the text could be field effect transistors, and vice versa. The resonators need not be a LC-type resonator, but also any other type of suitable resonator, such as a tank or a surface wave resonator. In addition to using hardware (e.g., within or coupled to a Central Processing Unit ("CPU"), microprocessor, microcontroller, digital signal processor, processor core, System on Chip ("SOC"), or any other device), implementations may also be embodied in software (e.g., computer readable code, program code, and/or instructions disposed in any form, such as source, object or machine language) disposed, for example, in a computer usable (e.g., readable) medium configured to store the software. Such software can enable, for example, the function, fabrication, modelling, simulation, description and/or testing of the apparatus and methods described herein. For example, this can be accomplished through the use of general programming languages (e.g., C, C++), hardware description languages (HDL) including Verilog HDL, VHDL, and so on, or other available programs. Such software can be disposed in any known computer usable medium such as semiconductor, magnetic disk, or optical disc (e.g., CD-ROM, DVD-ROM, etc.). The software can also be disposed as a computer data signal embodied in a computer usable (e.g., readable) transmission medium (e.g., carrier wave or any other medium including digital, optical, or analog-based medium). Embodiments of the disclosed antenna array, base transceiver station, apparatus, method or computer-program product may include methods of providing the apparatus described herein by providing software describing the apparatus and subsequently transmitting the software as a computer data signal over a communication network including the Internet and intranets.

It is understood that the apparatus and method described herein may be included in a semiconductor intellectual property core, such as a microprocessor core (e.g., embodied in HDL) and transformed to hardware in the production of integrated circuits. Additionally, the apparatus and methods described herein may be embodied as a combination of hardware and software. Thus, what is taught should not be limited by any of the above-described exemplary embodiments, but should be defined only in accordance with the following claims and their equivalents.

The invention claimed is:

1. An antenna array comprising a plurality of antenna elements and a plurality of amplifiers having power ratings and feeding the plurality of antenna elements, wherein a first group of the plurality of antenna elements is arranged in a rectilinear planar array of a first column of the antenna array and a second group of the plurality of antenna elements is arranged in a rectilinear planar array of a second column of the antenna array, wherein a first amplifier of the plurality of amplifiers has a first power rating and a second amplifier of the plurality of amplifiers has a second power rating, the first power rating being different than the second power rating, wherein the first column of the plurality of antenna elements is arranged symmetrical to the second column of the plurality of antenna elements about a rectilinear parallel axis, and wherein the amplifiers feeding the first column of the plurality of antenna elements have a substantially similar power rating to the corresponding amplifiers feeding the parallel second column of the symmetrically corresponding one of the plurality of antenna elements, the antenna array further comprising a plurality of high power transceivers, the high power transceivers comprising one antenna element of said plurality of antenna elements and one amplifier of said plurality of amplifiers, wherein the amplifiers feeding the first column of the plurality of antenna elements and the amplifiers feeding the second column of the plurality of antenna elements are digitally linearized to enable tracking in amplitude and phase of the high power transceivers.

2. The antenna array of claim 1, wherein the power ratings of the amplifiers are chosen to form a power distribution profile over the antenna array.

3. The antenna array of claim 1, wherein the antenna array comprises an edge and wherein the power rating of the amplifiers tapers towards the edge of the antenna array.

4. The antenna array of claim 1, wherein the plurality of amplifiers is subdivided into two or more subsets of amplifiers, the power ratings of the amplifiers within one of the two or more subsets being substantially equal.

5. The antenna array of claim 1, wherein the first amplifier comprises two or more identical elementary amplifying devices having a first elementary power rating, and the second amplifier comprises at least one elementary amplifying device having a second elementary power rating.

6. The antenna array of claim 1, wherein said first amplifier and said second amplifier use identical device technology.

7. The antenna array of claim 6, wherein the identical device technology is selected from the group consisting of lateral double-diffused MOSFET technology, GaAs MESFET technology, and high electron mobility transistor technology.

8. The antenna array of claim 1, further comprising a compensator arranged to determine and compensate for at least one of amplitude, phase, delay and/or linearity deviations of at least one of the plurality of high power transceivers.

9. The antenna array of claim 8, comprising a plurality of said compensators, each one of said plurality of compensators being associated to one of the plurality of high power transceivers.

10. The antenna array of claim 9, wherein the plurality of compensators is arranged to determine at least one of relative amplitude, phase and/or linearity deviations relative to an aggregate value for the amplitude, phase and/or linearity.

11. The antenna array of claim 8, wherein the compensator is arranged to adjust at least one of an amplitude setting, a phase setting, a delay setting or a linearity setting of a corresponding one of the plurality of high power transceivers so as to reduce the amplitude, phase and/or linearity deviation of the corresponding one of the plurality of high power transceivers.

12. A base transceiver station comprising the antenna array comprising a plurality of antenna elements and a plurality of amplifiers having power ratings and feeding the plurality of antenna elements, wherein a first group of the plurality of antenna elements is arranged in a rectilinear planar array of a first column of the antenna array and a second group of the plurality of antenna elements is arranged in a rectilinear planar array of a second column of the antenna array, wherein a first amplifier of the plurality of amplifiers has a first power rating and a second amplifier of the plurality of amplifiers has a second power rating, the first power rating being different than the second power rating, wherein the first column of the plurality of rectilinear planar antenna elements is arranged symmetrical to the second column of the plurality of antenna elements about a rectilinear parallel axis, and wherein amplifiers feeding the first column of the plurality of antenna elements have a substantially similar power rating to corresponding amplifiers feeding the parallel second column of the symmetrically corresponding one of the plurality of antenna elements, the antenna array further comprising a plurality of high power transceivers, the high power transceivers comprising an antenna element of said plurality of rectilinear planar antenna elements and an amplifier of said plurality of amplifiers, wherein the amplifiers feeding the first column of the plurality of antenna elements and the amplifiers feeding the second column of the plurality of antenna elements are digitally linearized to enable tracking in amplitude and phase of the high power transceivers.

13. The base transceiver station of claim 12, wherein the antenna array further comprises a plurality of high power transceivers, each one of the high power transceivers comprising an antenna element of said plurality of antenna elements and an amplifier of said plurality of amplifiers, and wherein at least one of the plurality of high power transceivers is arranged to receive a baseband signal to be transmitted and comprises a modulator for modulating the baseband signal and an up-converter for performing a frequency translation of said base band signal.

14. A computer program product embodied on a non-transitory computer-readable medium and comprising executable instructions for the manufacture of the antenna array comprising a plurality of antenna elements and a plurality of amplifiers having power ratings and feeding the plurality of antenna elements, wherein a first group of the plurality of antenna elements is arranged in a rectilinear planar array of a first column of the antenna array and a second group of the plurality of antenna elements is arranged in a rectilinear planar array of a second column of the antenna array, wherein a first amplifier of the plurality of amplifiers has a first power rating and a second amplifier of the plurality of amplifiers has a second power rating, the first power rating being different than the second power rating, wherein the first column of the plurality of antenna elements is arranged symmetrical to the second column of the plurality of antenna elements about a rectilinear parallel axis, and wherein amplifiers feeding the first column of the plurality of antenna elements have a substantially similar power rating to corresponding amplifiers feeding the parallel second column of the symmetrically corresponding one of the plurality antenna elements, the antenna array further comprising a plurality of high power transceivers, the high power transceivers comprising one antenna element of said plurality of antenna elements and one amplifier of said plurality of amplifiers, wherein the amplifiers feeding the first column of the plurality of antenna elements and the amplifiers feeding the second column of the plurality of antenna elements are digitally linearized to enable tracking in amplitude and phase of the high power transceivers.

* * * * *